US007837188B2

(12) United States Patent
Lee et al.

(10) Patent No.: US 7,837,188 B2
(45) Date of Patent: Nov. 23, 2010

(54) PAPER-STOPPED LINKAGE MECHANISM

(75) Inventors: Yang-Teh Lee, Taipei (TW); Hsien-Chang Wu, Banciao (TW)

(73) Assignee: Cal-Comp Electronics & Communications Company Limited, Taipei County (TW)

( * ) Notice: Subject to any disclaimer, the term of this patent is extended or adjusted under 35 U.S.C. 154(b) by 343 days.

(21) Appl. No.: 12/068,367

(22) Filed: Feb. 6, 2008

(65) Prior Publication Data

US 2009/0194937 A1 Aug. 6, 2009

(51) Int. Cl.
*B65H 3/06* (2006.01)

(52) U.S. Cl. ..... 271/117

(58) Field of Classification Search ..... 271/117, 271/118

See application file for complete search history.

(56) References Cited

U.S. PATENT DOCUMENTS 5,141,217 A * 8/1992 Lim et al. ..... 271/10.13
6,431,541 B2 * 8/2002 Kuo et al. ..... 271/118
6,651,972 B2 * 11/2003 Hsiao et al. ..... 271/114
6,991,227 B2 * 1/2006 Kim ..... 271/10.12
7,530,563 B2 * 5/2009 Kuo ..... 271/124
2004/0071486 A1 * 4/2004 Manabe et al. ..... 399/367
2007/0001374 A1 * 1/2007 Lee ..... 271/117

* cited by examiner

*Primary Examiner*—Stefanos Karmis
*Assistant Examiner*—Michael C McCullough
(74) *Attorney, Agent, or Firm*—Rosenberg, Klein & Lee

(57) ABSTRACT

A paper-stopped linkage mechanism, located at the upper cover of the office machine, includes a paper feeder mechanism, a paper stopper mechanism and a linkage. The paper feeder mechanism is movably located at the upper cover and has at least one paper-feeding roller. The paper stopper mechanism is movably located at the upper cover. The linkage is swingingly pivoted with the upper cover. The linkage has a first linking portion and a second linking portion. The first linking portion and the second linking portion are respectively connected with the paper feeder mechanism and the paper stopper mechanism. The paper feeder mechanism and the paper stopper mechanism are linked by the linkage and move in the opposite directions. Both the paper feeder mechanism and the paper stopper mechanism are located at the upper cover and are linked by the linkage so that the paper stopper mechanism can be driven immediately.

6 Claims, 8 Drawing Sheets

PAPER-STOPPED LINKAGE MECHANISM

BACKGROUND OF THE INVENTION

1. Field of the Invention

The present invention relates to a paper-stopped linkage mechanism. In particular, this invention relates to a paper-stopped linkage mechanism that is applied to a multi-function office machine and can stop the redundant paper.

2. Description of the Related Art

The office machines, such as the copy machine, the fax machine, the printer, and the scanner, are the necessaries in the office. They can enhance the working quality and efficiency. However, each office machine needs a space. It will be a problem for the user when the user's space is small. As the technology has been developed, a multi-function office machine is developed. All functions are integrated into one machine. The required space is reduced and the user's working efficiency is improved.

FIG. 1 shows a paper stopper mechanism in a multi-function office machine of the prior art. It can stop the paper and prevent the redundant paper from being rolled into the machine. The paper stopper mechanism 10*a* and the paper feeder mechanism 20*a* are respectively located above and below the office machine, and are connected together by a linkage 30*a*. When the paper 40*a* contacts the blocking board 11*a*, the paper sensor 50*a* moves downwards due to a paper 40*a* passes through the paper sensor 50*a*, and is in a paper 40*a* sensing status. Next, a gear set drives the paper feeder mechanism 20*a* to move downwards so that the blocking board 11*a* also moves downwards. After the paper 40*a* passes through the scanning sensor 60*a*, a scanning process is performed. Finally, the paper feeder mechanism 20*a* moves upwards and the blocking board 11*a* also moves upwards. After the scanning process is finished, all mechanisms go back to their original locations.

Reference is made to FIGS. 2 and 3. Except for the linkage 30*a* being in the paper-feeding status, the linkage 30*a* naturally descends due to the long portion 31*a* is heavy. At this time, the blocking board 11*a* ascends to achieve the paper-stopping function. When the paper is fed, the gear set 70*a* rotates counterclockwise to make the clutch 80*a* rotate. The contacting surface 81*a* of the clutch 80*a* contacts the traverse-rod portion 32*a* of the linkage 30*a*. Therefore, the long portion 31*a* of the linkage 30*a* ascends, the short portion 33*a* descends, and the blocking board 11*a* descends. When the gear set 70*a* rotates clockwise, the gear set 70*a* does not push the linkage 30*a*. At this time, the long portion 31*a* of the linkage 30*a* descends and the short portion 33*a* ascends due to the gravity. Thereby, the paper-stopping function is achieved.

However, the paper stopper mechanism 10*a* of the prior art is located at the lower side and uses the linkage principle to ascend and descend the paper stopper mechanism 10*a*, and the paper feeder mechanism 20*a* is located at the upper side. When the paper is fed, the paper feeder mechanism 20*a* descends and the blocking board 11*a* of the paper stopper mechanism 10*a* also descends due to the linkage 30*a*. In order to prevent another paper from being fed, the paper feeder mechanism 20*a* ascends and the blocking board 11*a* also ascends due to the linkage 30*a*. Therefore, both the paper stopper mechanism 10*a* and the paper feeder mechanism 20*a* move in the same direction. Because the paper stopper mechanism 10*a* and the paper feeder mechanism 20*a* are respectively located at the lower side and the upper side and are linked by the linkage 30*a*, the gear set 70*a*, and the clutch 80*a*, the paper stopper mechanism 10*a* cannot be driven immediately.

SUMMARY OF THE INVENTION

One particular aspect of the present invention is to provide a paper-stopped linkage mechanism. The paper stopper mechanism can be driven immediately.

The paper-stopped linkage mechanism is located at the upper cover of the office machine. The paper-stopped linkage mechanism includes a paper feeder mechanism movably located at the upper cover, a paper stopper mechanism movably located at the upper cover, and a linkage swingingly pivoted with the upper cover. The paper feeder mechanism has at least one paper-feeding roller. The paper-feeding roller is connected with a gear set. The linkage has a first linking portion and a second linking portion. The first linking portion is connected with the paper feeder mechanism. The second linking portion is connected with the paper stopper mechanism. The paper feeder mechanism and the paper stopper mechanism are linked by the linkage and move in the opposite directions.

The present invention has the following characteristics. Both the paper feeder mechanism and the paper stopper mechanism are located at the upper cover and are linked by a linkage. When the paper feeder mechanism descends to feed the paper, the blocking board immediately ascends due to the linkage. Thereby, the paper-feeding function is achieved. When the paper feeder mechanism ascends, the blocking board immediately descends to stop the paper due to the linkage. Both the paper feeder mechanism and the paper stopper mechanism move in the opposite directions. Because both the paper feeder mechanism and the paper stopper mechanism are located at the upper cover and are linked by the linkage, the paper stopper mechanism can be driven immediately.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
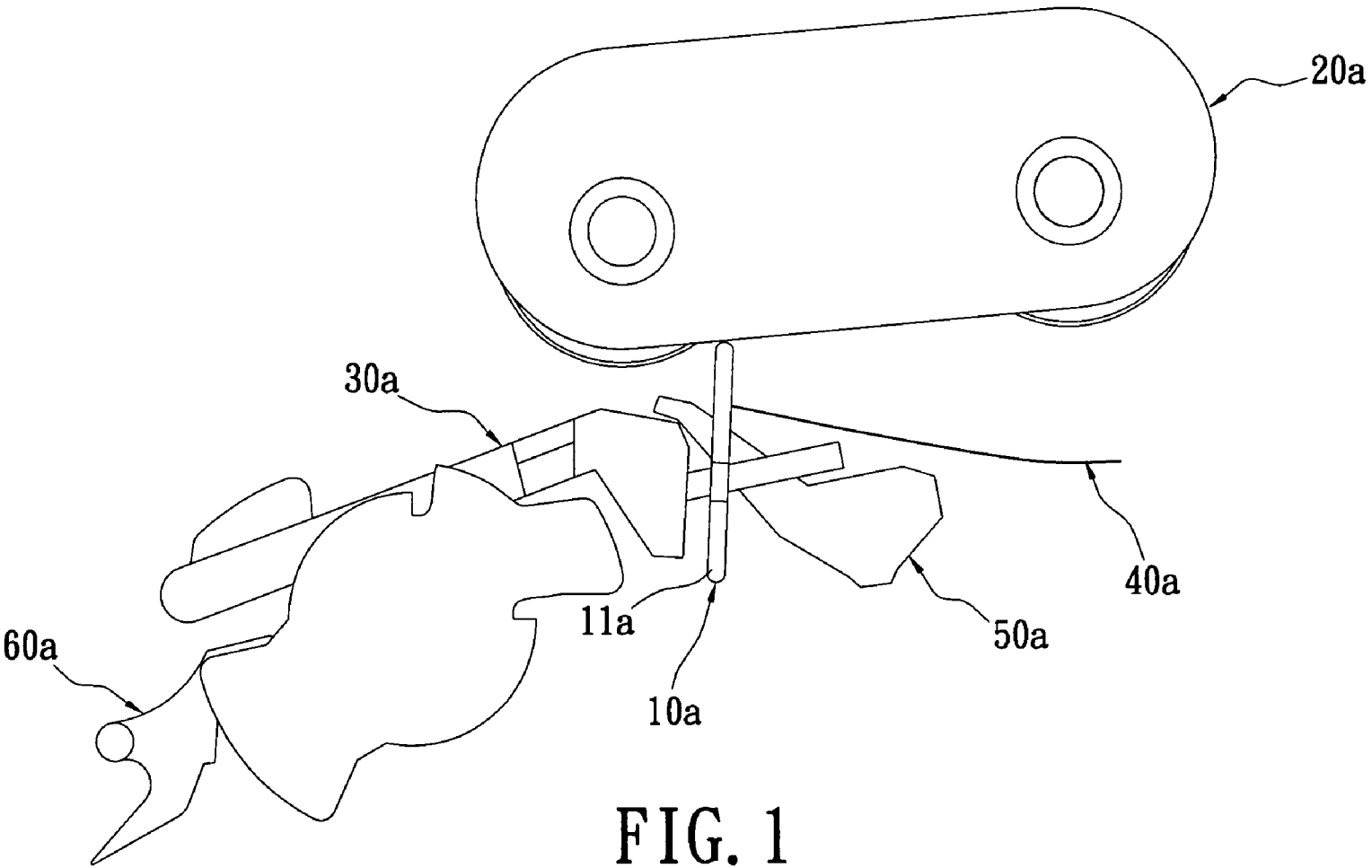
FIG. 1 PRIOR ART
FIG. 1 is a schematic diagram of the paper stopper mechanism of the prior art.
Figure 2:
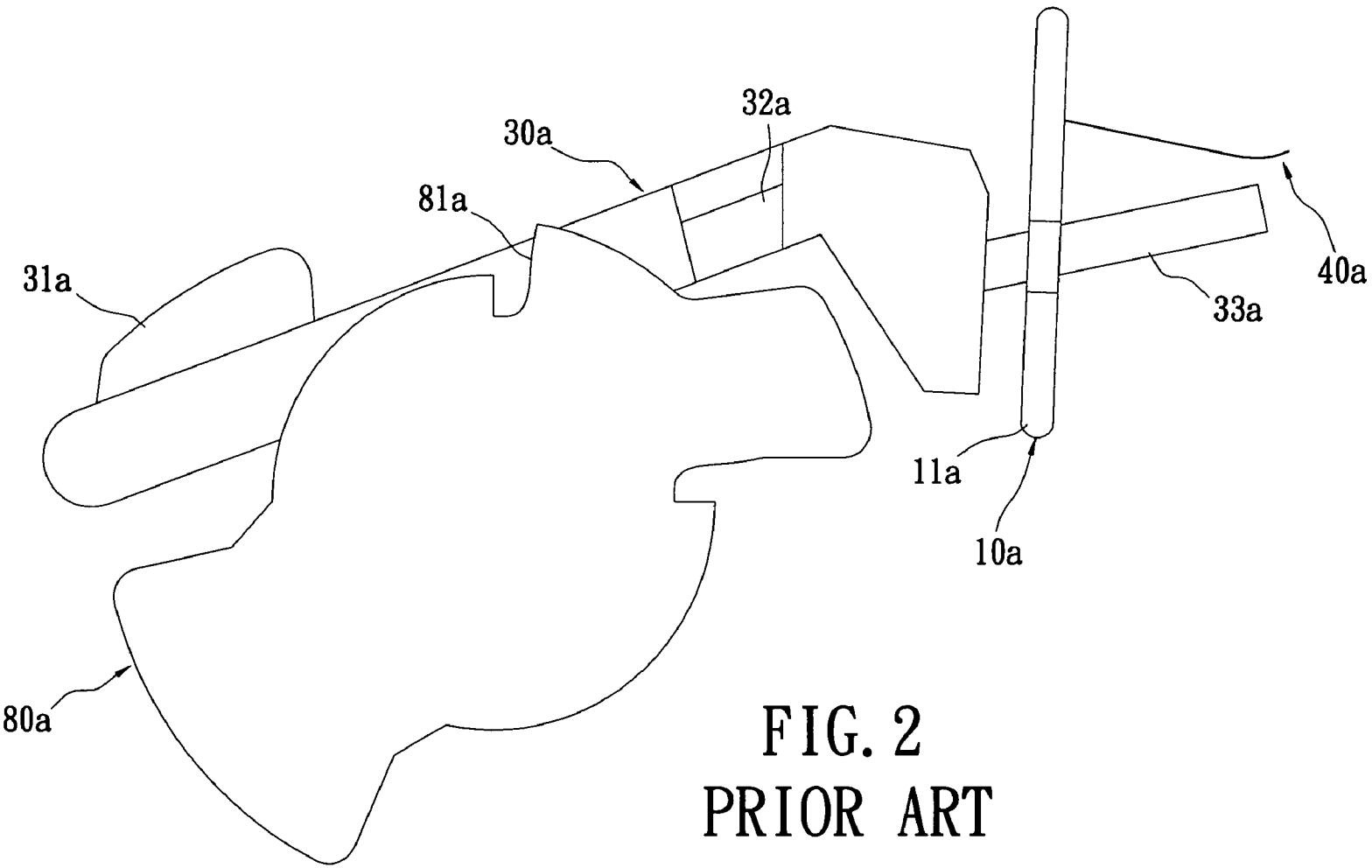
FIG. 2 PRIOR ART
FIG. 2 is a schematic diagram of part of the paper stopper mechanism of the prior art.
Figure 3:
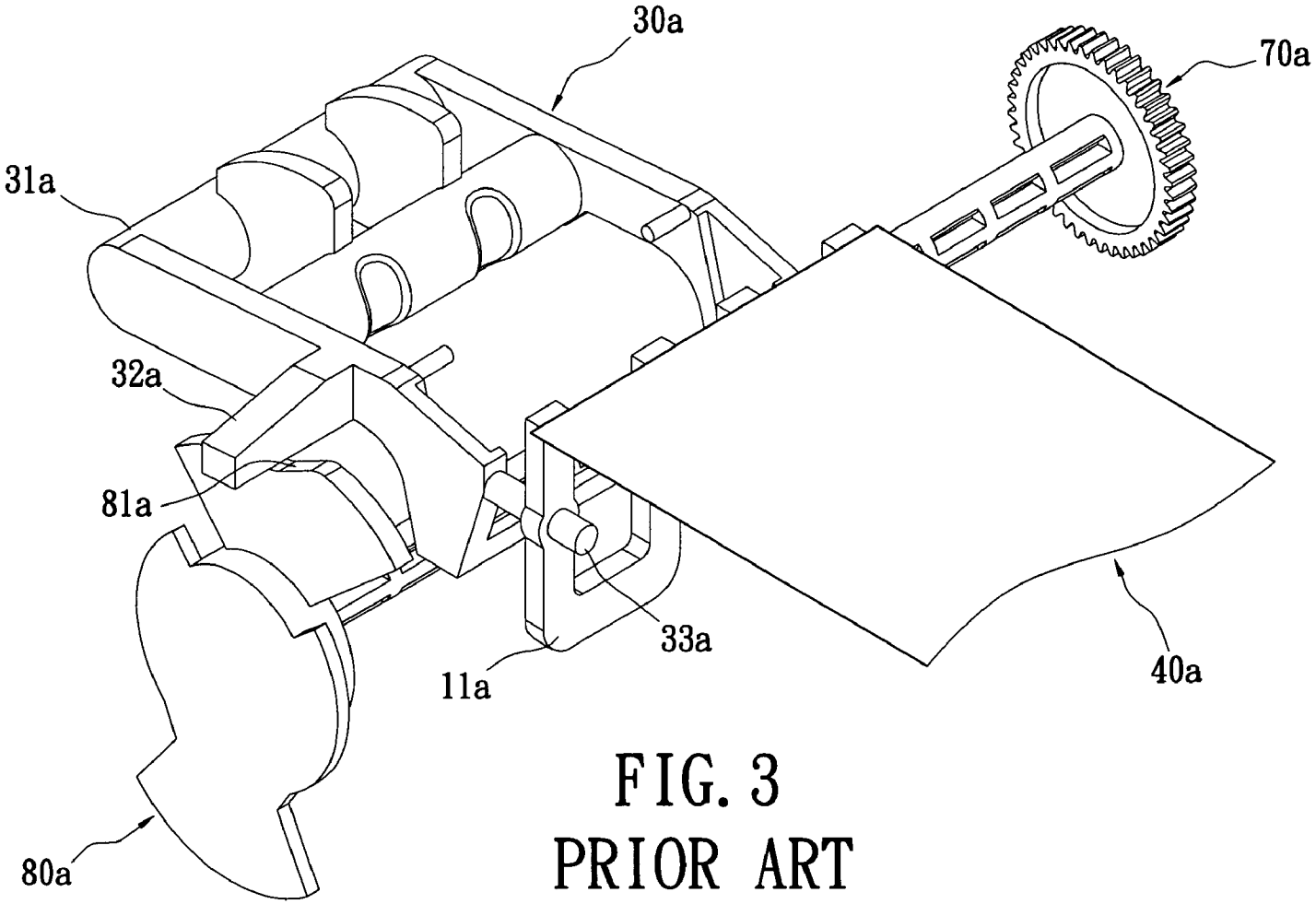
FIG. 3 PRIOR ART
FIG. 3 is a perspective view of the paper stopper mechanism of the prior art.
Figure 4:
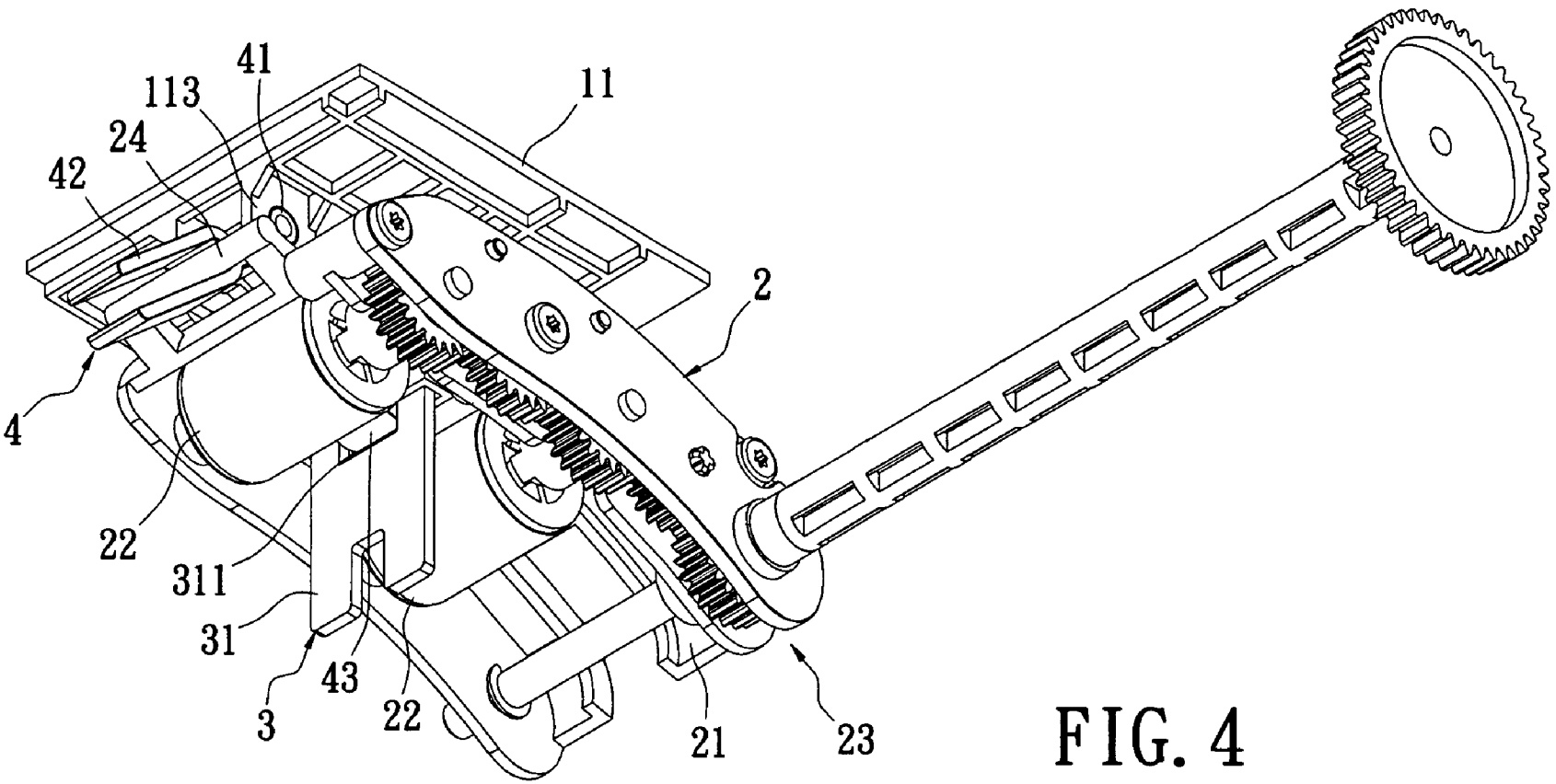
FIG. 4 is a perspective view of the paper-stopped linkage mechanism of the present invention.
Figure 5:
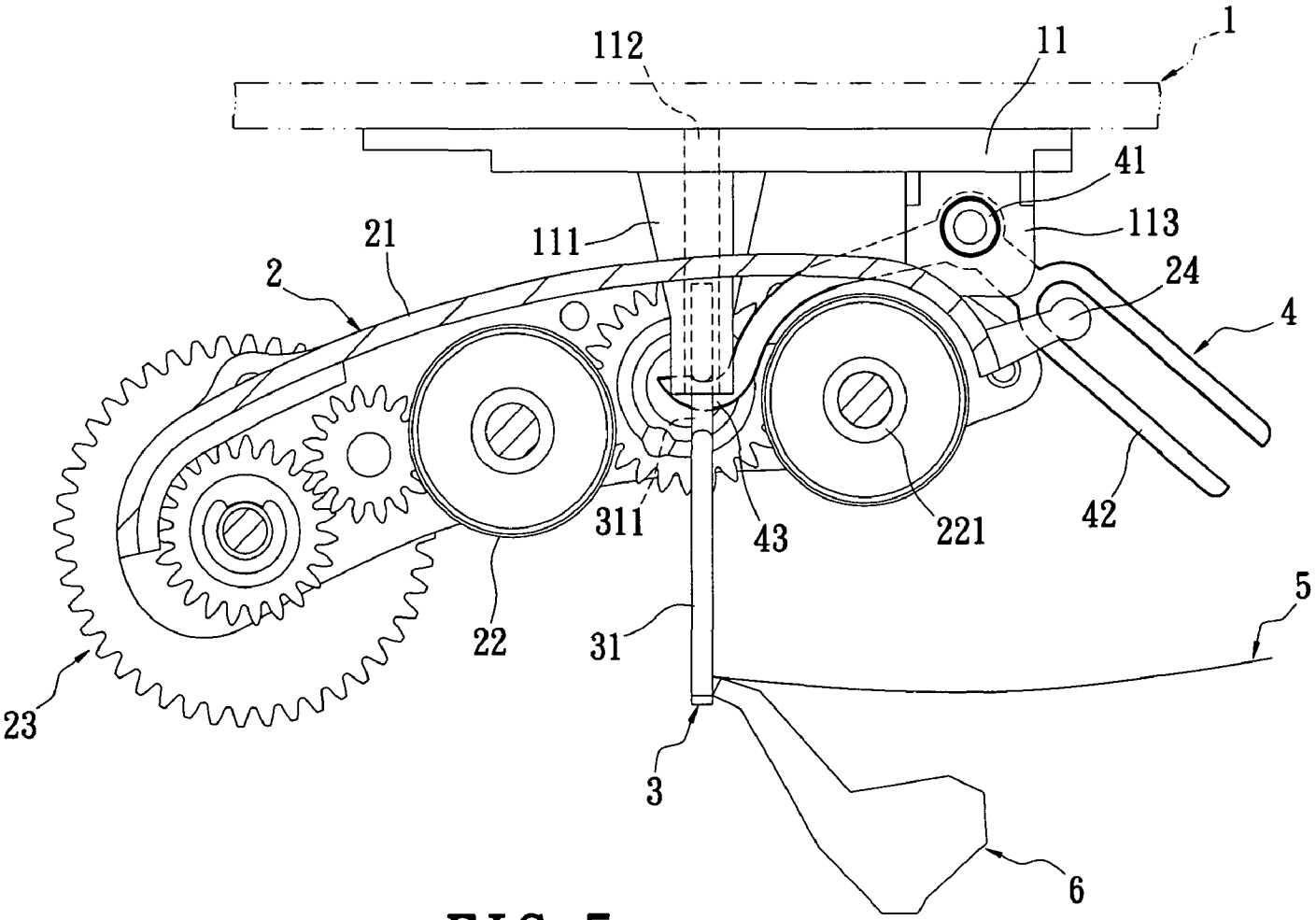
FIG. 5 is a cross-sectional view of the paper-stopped linkage mechanism of the present invention.

Reference is made to FIGS. 4 and 5. The paper-stopped linkage mechanism is applied to a multi-function office machine. The paper-stopped linkage mechanism includes a paper feeder mechanism 2, a paper stopper mechanism 3, and a linkage 4. Both the paper feeder mechanism 2 and the paper stopper mechanism 3 are located the inner side of the upper cover 1 of the office machine. The inner side of the upper cover 1 has a base 11. The base 11 is fastened onto the upper cover 1. The bottom of the base 1 protrudes to form an ascending-descending portion 111. There is a sliding slot 112 in the ascending-descending portion 111 for being installed with the paper stopper mechanism 3. The bottom of the base 1 protrudes to form a pivoting portion 113 for being installed with the linkage 4.

The paper feeder mechanism 2 is located the inner side of the upper cover 1 and is driven by a gear set 23 to ascend and descend. The paper feeder mechanism 2 is located at the upper cover and can move upwards and downwards. The paper feeder mechanism 2 has one frame 21 and two paper-feeding rollers 22 pivoted with the frame 21. The two paper-feeding rollers 22 are connected with the gear set 23 and the power from a power source, such as a motor (not shown in the figure), is transmitted to the two paper-feeding rollers 22 via the gear set 23. Therefore, the two paper-feeding rollers 22 are driven to feed the paper forwards. The paper feeder mechanism 2 is also driven by the gear set 23 to perform ascending and descending operations.

In this embodiment, the paper stopper mechanism 3 is a blocking board 31. The blocking board 31 fits in the sliding slot 112 of the ascending-descending portion 111 of the base 11 so that the blocking board 31 is installed at the base 11 of the upper cover 1 and can move upwards and downwards. When the blocking board 31 ascends, the paper-feeding path is opened. When the blocking board 31 descends, the paper-feeding path is blocked. The blocking board 31 has a through hole 311.

The linkage 4 has a pivot portion 41, a first linking portion 42 extending from one side of the pivot portion 41, and a second linking portion 43 extending from the other side of the pivot portion 41. In this embodiment, the first linking portion 42 has a diverged shape. The second linking portion 43 has a hooked shape. The linkage 4 uses the pivot portion 41 to pivot with the pivoting portion 113 of the base 11 so that the linkage is pivoted with the base 11 of the upper cover 1 and can swing. The first linking portion 42 of the linkage 4 is straddled on a linkage 24 located at one side of the frame 21 of the paper feeder mechanism 2 so that the first linking portion 42 of the linkage 4 is connected with the paper feeder mechanism 2. The second linking portion 43 of the linkage 4 hooks the through hole 311 of the blocking board 31 so that the second linking portion 43 of the linkage 4 is connected with the paper stopper mechanism. Thereby, the paper feeder mechanism 2 and the paper stopper mechanism 3 located at the upper cover 1 are linked by the linkage 4.

Figure 6:
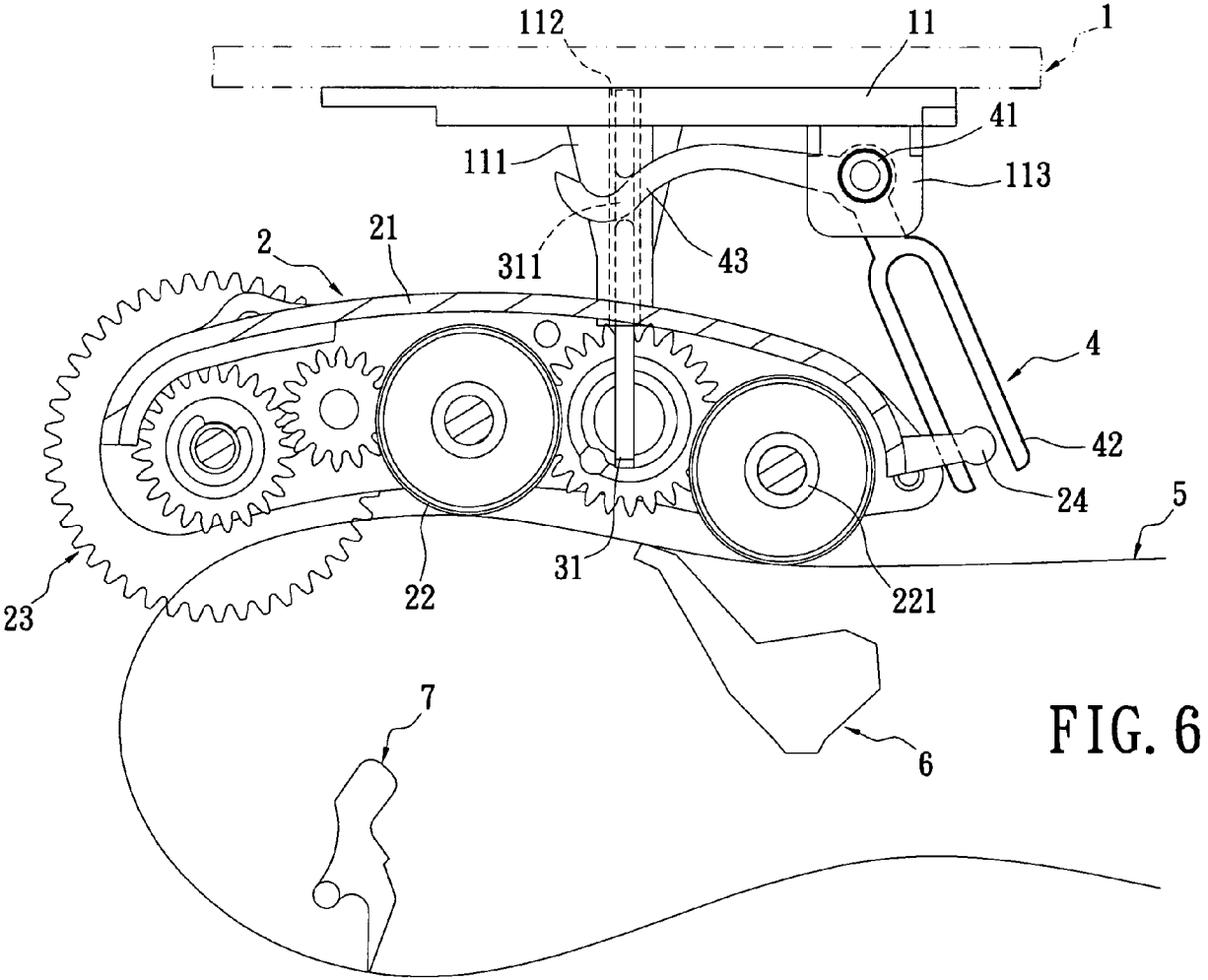
FIG. 6 is a schematic diagram of the operation of the paper-stopped linkage mechanism of the present invention.
Figure 7:
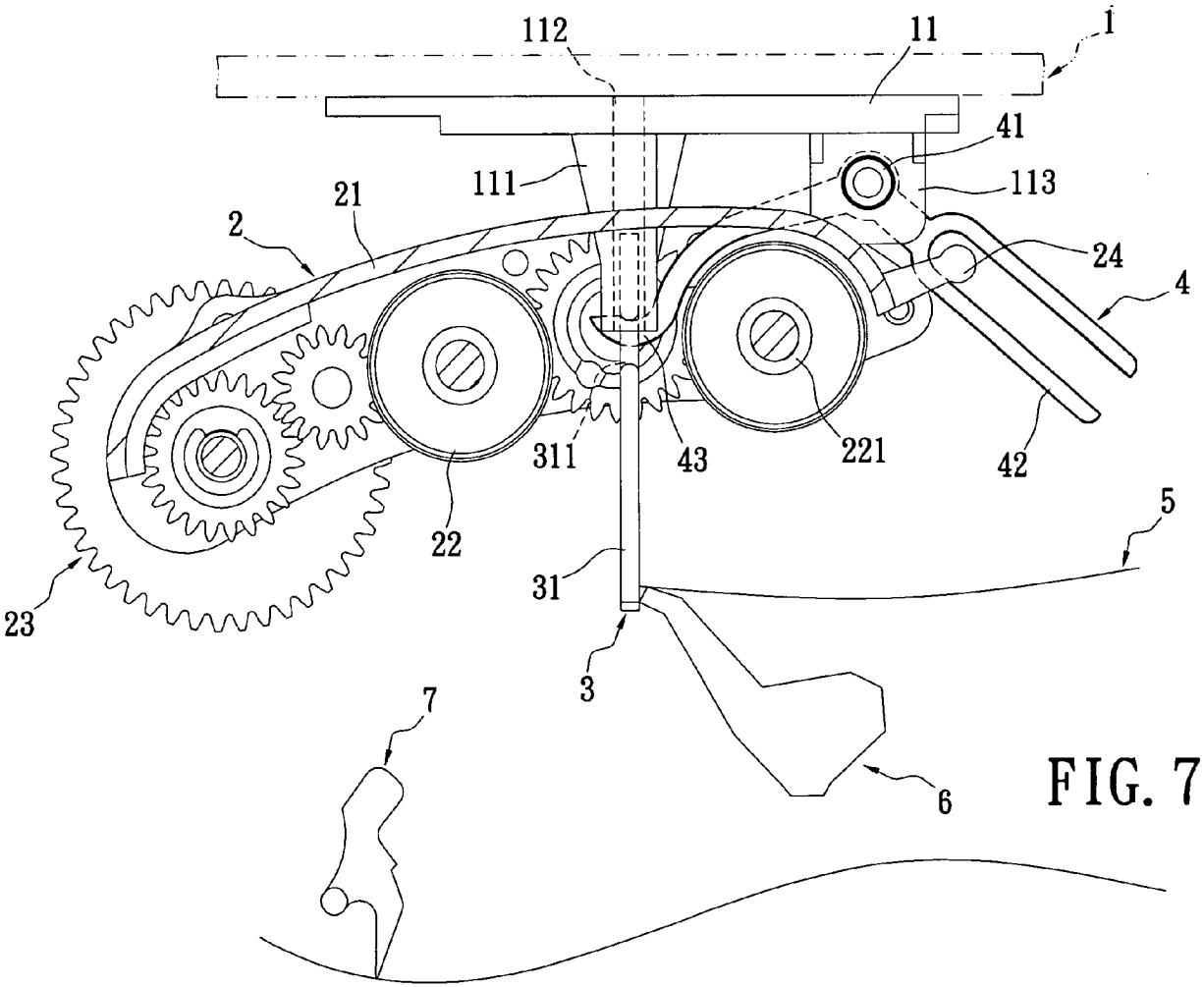
FIG. 7 is another schematic diagram of the operation of the paper-stopped linkage mechanism of the present invention.

Reference is made to FIGS. 5~7. When the paper 5 contacts the blocking board 31 (as shown in FIG. 5), the paper sensor 6 rotates downwards due to the paper 5 passes through the paper sensor 6 and is in a paper-sensing status. Next, the motor transmits the power to the gear set 23 to drive the paper feeder mechanism 2 to descend (as shown in FIG. 6). Simultaneously, the linkage 24 of the paper feeder mechanism 2 is pressed downwards to make the first linking portion 42 of the linkage 4 descend. The second linking portion 43 ascends to make the blocking board 31 ascend. After the paper 5 passes through the scanning sensor 7, a scanning process is performed. Next, the gear set 23 rotates in an inverse direction, to make the paper feeder mechanism 2 ascend (as shown in FIG. 7). The blocking board 31 descends to block the paper due to the linkage 4. After the scanning process is finished, the blocking board 31 goes back to its original location.

Figure 8:
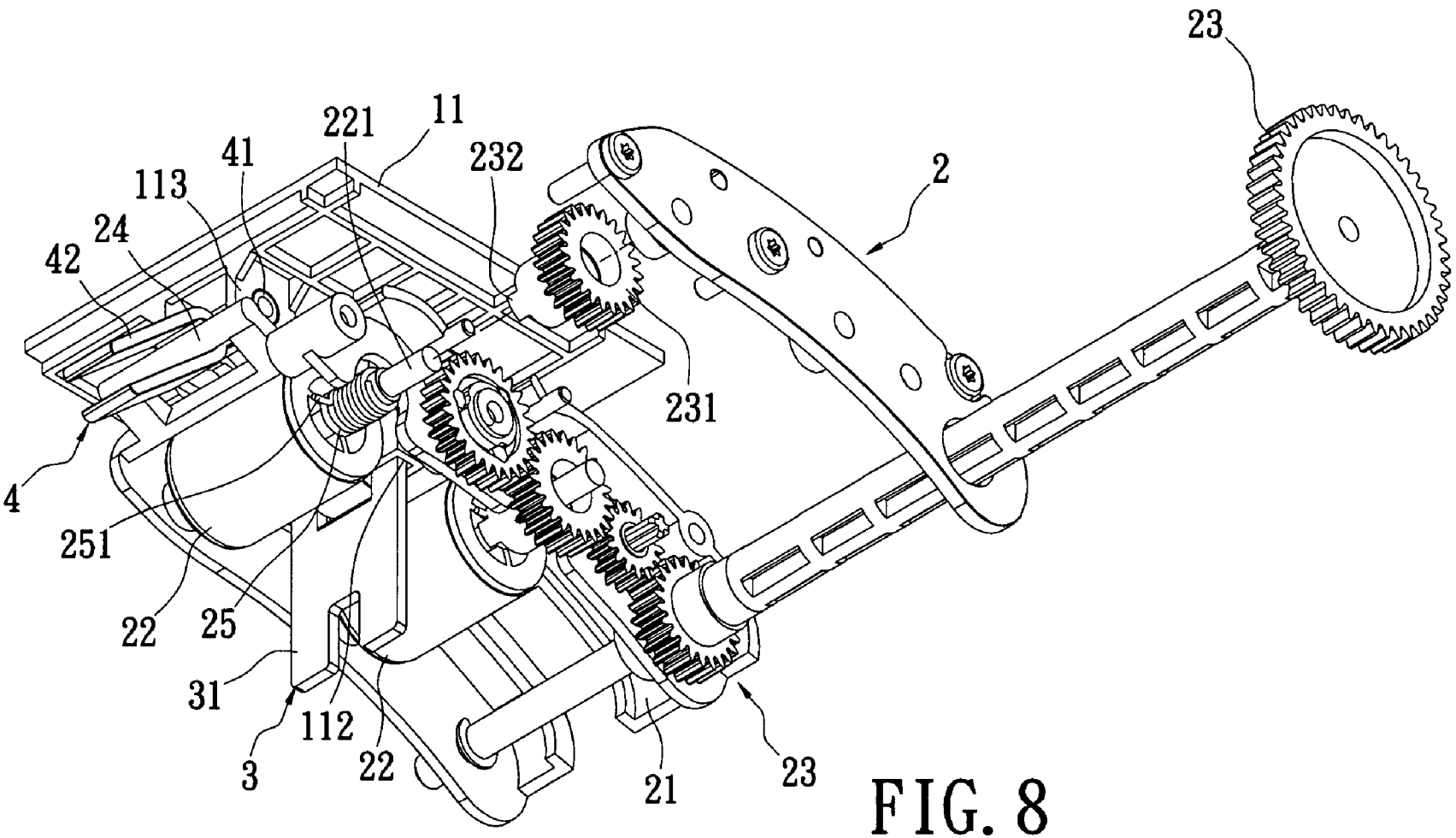
FIG. 8 is a perspective view of the paper-stopped linkage mechanism of the second embodiment of the present invention.

Reference is made to FIG. 8. The paper-feeding roller 22 has a shaft part 221, and the gear set 23 has a clutching gear 231 that corresponds to the shaft part 221. The clutching gear 231 is rotatably sleeved onto the shaft part 221 of the paper-feeding roller 22. There is a twisted spring 25 between the paper-feeding roller 22 and the clutching gear 231. There is a predetermined interference (about 0.01~0.02 mm) between the twisted spring 25 and the shaft part 221 to generate the clutching function with the shaft part 221. One end of the twisted spring 25 has a traverse rod 251. The clutching gear 231 has a convex block 232 that corresponds to the traverse rod 251.

When the gear set 23 drives the paper feeder mechanism 2 to descend, the twisted spring 25 rotates in one direction to reduce the inner diameter and lock the shaft part 221 so that the paper-feeding rollers 22 rotate. At this time, the paper is fed due to the friction force of the robber of the paper-feeding rollers 22. When the gear set 23 rotates in the inverse direction to drive the paper feeder mechanism 2 to ascend, the convex block 232 of the clutching gear 231 pushes the traverse rod 251 of the twisted spring 25 so that the twisted spring 25 rotates in the inverse direction. The inner diameter of the twisted spring increases to loose the shaft part 221. Therefore, the paper-feeding rollers 22 cannot be rotated.

Both the paper feeder mechanism 2 and the paper stopper mechanism 3 are located at the upper cover 1 and are linked by the linkage 4. When the paper feeder mechanism 2 descends to feed the paper, the blocking board 31 immediately ascends due to the linkage 4. Thereby, the paper-feeding function is achieved. Alternatively, when the paper feeder mechanism 2 ascends, the blocking board 31 immediately descends to stop the paper due to the linkage 4. Both the paper feeder mechanism 2 and the paper stopper mechanism 3 move in the opposite directions. Because both the paper feeder mechanism 2 and the paper stopper mechanism 3 are located at the upper cover 1 and are linked by the linkage 4, the paper stopper mechanism 4 can be driven immediately.

Furthermore, the present invention also utilizes the predetermined interference with small distance between the twisted spring 25 and the shaft part 221 and the characteristic of the twisted spring 25. When the twisted spring 25 rotates in one direction to reduce the inner diameter and lock the shaft part 221, the paper-feeding rollers 22 are rotated to achieve the paper-feeding function. When the twisted spring 25 rotates in an inverse direction, the inner diameter of the twisted spring 25 increases to loose the shaft part 221 and the paper-feeding rollers 22 cannot be rotated. Therefore, the scanning quality is enhanced when the automatic paper-feeding mechanism feeds the paper to perform the scanning process.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. A paper-stopped linkage mechanism, located at an upper cover of an office machine, comprising:

a paper feeder mechanism movably located at the upper cover, wherein the paper feeder mechanism has at least one paper-feeding roller, and the at least one paper-feeding roller is connected with a gear set;

a paper stopper mechanism movably located at the upper cover; and a linkage swingingly pivoted with the upper cover, wherein the linkage has a first linking portion and a second linking portion;

the first linking portion is connected with the paper feeder mechanism;

the second linking portion is connected with the paper stopper mechanism, and the paper feeder mechanism and the paper stopper mechanism are linked by the linkage and move in opposite directions wherein the first linking portion is U-shaped, the paper feeder mechanism has a linkage, and the first linking portion substantially captures the linkage of the paper feeder mechanism.

2. The paper-stopped linkage mechanism as claimed in claim 1, wherein the upper cover has a base on an inner side thereof, the base has an ascending-descending portion on a bottom surface thereof, the ascending-descending portion has a sliding slot thereinside, the paper stopper mechanism is a blocking board, and the blocking board fits in the sliding slot of the ascending-descending portion of the base.

3. The paper-stopped linkage mechanism as claimed in claim 1, wherein the upper cover has a base on an inner side thereof, the base has a pivoting portion on a bottom surface thereof, the linkage has a pivot portion, the first linking portion extends from one side of the pivot portion, the second linking portion extends from other side of the pivot portion, and the linkage uses the pivot portion to pivot with the pivoting portion of the base.

4. The paper-stopped linkage mechanism as claimed in claim 1, wherein the at least one paper feeder mechanism has a frame, and the at least one paper-feeding roller is pivoted with the frame.

5. The paper-stopped linkage mechanism as claimed in claim 1, wherein the second linking portion has a hooked shape, the paper stopper mechanism has a through hole, and the second linking portion hooks the through hole.

6. The paper-stopped linkage mechanism as claimed in claim 1, wherein the at least one paper-feeding roller has a shaft part, the gear set has at least one clutching gear, the at least one clutching gear is rotatably sleeved onto the shaft part, a twisted spring is disposed between the at least one paper-feeding roller and the at least one clutching gear, the twisted spring is sleeved onto the shaft part, there is a predetermined interference between the twisted spring and the shaft part, one end of the twisted spring has a traverse rod, and the at least one clutching gear has a convex block corresponding to the traverse rod.

* * * * *